US011448395B1

(12) United States Patent
Li et al.

(10) Patent No.: US 11,448,395 B1
(45) Date of Patent: Sep. 20, 2022

(54) HIGH-TEMPERATURE REHEATER ANTI-FRICTION DEVICE

(71) Applicant: HUANENG POWER INTERNATIONAL, INC. SHANGHAI SHIDONGKOU FIRST POWER PLANT, Shanghai (CN)

(72) Inventors: Biao Li, Shanghai (CN); Xiaofeng Wu, Shanghai (CN); Ping Shen, Shanghai (CN); Shun Wang, Shanghai (CN); Qiudi Zhang, Shanghai (CN); Lucheng Jin, Shanghai (CN)

( * ) Notice: Subject to any disclaimer, the term of this patent is extended or adjusted under 35 U.S.C. 154(b) by 0 days.

(21) Appl. No.: 17/447,184

(22) Filed: Sep. 8, 2021

(30) Foreign Application Priority Data

Apr. 28, 2021 (CN) ..... 202110465248.5

(51) Int. Cl.
*F22G 3/00* (2006.01)
*F23J 3/00* (2006.01)

(52) U.S. Cl.
CPC ..... *F22G 3/008* (2013.01); *F23J 3/00* (2013.01)

(58) Field of Classification Search
CPC . F22G 3/008; F22G 1/04; F22G 3/009; F22B 37/107; F22B 37/108; F22B 37/18; F23J 3/00; F16L 57/06; F28F 2265/02; F24F 19/02–06
See application file for complete search history.

(56) References Cited

U.S. PATENT DOCUMENTS

2014/0196873 A1* 7/2014 Weber ..... F23J 3/023 165/172

FOREIGN PATENT DOCUMENTS

| | | | | |
|---|---|---|---|---|
| CN | 207584803 U | * | 7/2018 | |
| CN | 208635086 U | * | 3/2019 | |
| CN | 110160031 A | * | 8/2019 | |
| CN | 111351066 A | * | 6/2020 | ..... F23C 5/08 |
| FR | 2579739 A1 | * | 10/1986 | |

* cited by examiner

*Primary Examiner* — Edelmira Bosques
*Assistant Examiner* — Michael James Giordano
(74) *Attorney, Agent, or Firm* — W&K IP

(57) ABSTRACT

The present invention relates to a high-temperature reheater anti-friction device for anti-friction of metal tubes on a heated surface of a high-temperature reheater adjacent to a soot blower, has a hole-type tube clamp arranged on a metal tube of a heated surface of a high-temperature reheater, an anti-friction box and an anti-friction cover. Compared with the prior art, the present invention has the advantages of reduced maintenance workload of the unit and prolonged service life of the metal tube.

10 Claims, 9 Drawing Sheets

Anti-friction box

HIGH-TEMPERATURE REHEATER ANTI-FRICTION DEVICE

CROSS-REFERENCE TO RELATED APPLICATIONS

This is a U.S. patent application which claims the priority and benefit of Chinese Patent Application Number 202110465248.5, filed on Apr. 28, 2021, the disclosure of which is incorporated herein by reference in its entirety.

TECHNICAL FIELD

The present invention relates to the field of anti-friction of thermal power plant equipment, in particular to a high-temperature reheater anti-friction device.

BACKGROUND ART

At present, the high-temperature reheater of π-type boilers in thermal power plants is usually arranged in the horizontal flue at an outlet of a furnace, with a suspended tube screen structure. When the boiler is in operation, the heated surface of the high-temperature reheater will lead to ash accumulation and coking, such that the heat transfer deteriorates, therefore, a long retractable rotary steam soot blower is arranged adjacent to the heated surface to clean the heated surface by blowing soot on the heated surface.

As to the soot blowing medium, steam at a pressure of 1-1.5 MPa and a temperature of 350° C. is usually adopted, the effective blowing radius of the soot blower is about 1.5-2 meters, ash residues are blown away from the heated surface using kinetic energy of steam jets, so when the heated surface is cleaned, an adverse consequence that the metal tube wall will be scoured and thinned will be caused at the same time. In response to this situation, the following solution is usually taken: an anti-friction tile is mounted outside the tube of part of the high-temperature reheater in the soot blowing steam blowing area. However, due to the small interval between the tubes, an anti-friction tile cannot be mounted on each tube in the tube row, therefore, the anti-friction tile is generally mounted only on the first tube of the outer circle facing towards the side of the soot blowing steam, and since the anti-friction tile cannot wrap around the tube for the entire circle, therefore, the anti-friction blind area is large, and the effect is not ideal.

In addition, due to the unevenness of the tube screen (screen heated surface arranged in the furnace), some of the tubes are out of the rank, then the tubes out of the rank are scoured and abraded, and one of the main reasons for the unevenness of the tube screen is that the tube clamp of the originally designed tube screen is short in service life under the effect of high-temperature flue gas. The tube clamp is of a plate structure, and the fitting degree with the tube is small, so the cooling effect obtained through the tube medium is poor, and the middle section of the tube clamp is thin due to the thin wall thickness of the steel plate, therefore, the plate tube clamp is prone to bending, cracking, high-temperature burning and other failures after a period of operation.

In summary, aiming at the soot blowing steam loss of the high-temperature reheater, the current anti-friction tile and plate tube clamp have the problems of larger anti-friction blind area and being out of rank of the tube screen due to failure of the tube clamp, therefore, the range of the furnace tube damaged due to blowing is large, and the thinning speed is fast, meanwhile, since the wall of the high-temperature reheater tube is thin and is generally 4-5 mm, thereby easily causing accidents of tube bursting, bringing hidden dangers to the safe operation of the unit, and increasing maintenance workload.

SUMMARY OF THE INVENTION

The object of the present invention is to overcome the above shortcomings in the prior art and provide a high-temperature reheater anti-friction device.

The object of the present invention is realized through the following technical solution:

A high-temperature reheater anti-friction device for anti-friction of metal tubes on a heated surface of a high-temperature reheater adjacent to a soot blower, wherein the device includes a hole-type tube clamp, an anti-friction box and an anti-friction cover arranged on the metal tubes on the heated surface of the high-temperature reheater, the metal tube includes a plurality of furnace tubes arranged in parallel at equal intervals, each furnace tube includes a U-shaped bent tube section and a vertical tube section arranged above the U-shaped bent tube section, the hole-type tube clamp is sleeved and clamped on the vertical tube section of the metal tube, the anti-friction box is covered on the vertical tube section adjacent to the side of the soot blower, the anti-friction cover includes a 90° anti-friction cover covering the outermost furnace tube on the side, adjacent to the soot blower, of the U-shaped bent tube section, and a straight anti-friction cover covering the innermost furnace tube on the side, adjacent to the soot blower, of the vertical tube section, the top of the 90° anti-friction cover is welded to the bottom of the anti-friction box, and the top of the straight anti-friction cover is welded to the bottom of the hole-type tube clamp.

The hole-type tube clamp includes two clamping parts arranged symmetrically, the two clamping parts are respectively provided with a central connecting plate and a plurality of semi-circular docking units which are arranged in parallel and symmetrically on both sides of the central connecting plate, and the central position of each semi-circular docking unit is provided with a semi-circular hole for inserting each single furnace tube of the vertical tube section, and the two clamping parts are provided with fitting pieces to form a tube clamp with a plurality of circular mounting holes after fitting. The number of the semi-circular docking units in each clamping part is the same as the number of furnace tube bodies of the metal tube, and the dimension and shape of each semi-circular hole are the same as the outer diameter dimension and cross-sectional shape of the furnace tube body of the metal tube. The fitting piece includes a mounting bolt arranged between each semi-circular docking unit of one clamping part and a mounting hole arranged on the other clamping part for fitting with the mounting bolt. The inner diameter dimension of the semi-circular docking unit is the same as the outer diameter dimension of each single furnace tube of the vertical tube section to be clamped.

Further, the 90° anti-friction cover and the straight anti-friction cover are respectively fixed to the corresponding furnace tube by means of an anti-friction cover access board. The anti-friction cover access board is an arc-shaped plate structure, and the inner diameter corresponding to the radian of the anti-friction cover access board is the same as the outer diameter of the furnace tube.

Further, the device further includes a comb plate, wherein the comb plate is mounted in the central position of the U-shaped bent tube section. the comb plate includes a plate body and a number of strip-shaped holes arranged in parallel at equal intervals at one end of the plate body, the number of the strip-shaped holes is the same as the number of furnace tubes of the metal tube, the interval of each strip-shaped hole is the same as the interval of each furnace tube of the metal tube, and the width of each strip-shaped hole matches the outer diameter dimension of each furnace tube of the metal tube.

Compared with the prior art, the high-temperature reheater anti-friction device provided in the present invention at least has the following beneficial effects:

(1) By adding an anti-friction device of the present invention on a metal tube, scouring and abrasion caused by the flue gas and the soot blower on the furnace tube can be effectively reduced, the chance of abrasion and bursting of the furnace tube of the unit during operation is reduced, and the maintenance workload of the unit can also be reduced.

(2) The hole-type tube clamp can be used to greatly improve the fitness with the furnace tube and is conducive to cooling of the tube clamp; as to the material, high-temperature resistant stainless steel is adopted to increase the strength; the structure of the hole-type tube clamp is a symmetrical structure, the parts are fewer, clip mounting on site is facilitated, moreover, in the high-temperature flue gas environment, such failures as bending, cracking, high-temperature burning not easily happen, and after long-term use, tubes can be prevented from being out of rank, thereby effectively reducing abrasion of the furnace tube caused by flue gas and soot blowing steam, and prolonging the service life.

(3) By adding a high-temperature resistant stainless steel anti-friction box on the metal tube adjacent to the soot blower, and by adding an anti-friction cover at the bottom elbow of the tube on the outer ring, the furnace tube in the range damaged more obviously under the blowing of the soot blower is fully surrounded, thereby avoiding the shortcomings of existence of blind areas and easy falling off and other shortcomings of the conventional anti-friction cover, and further effectively avoiding blowing damage of the furnace tube caused by the soot blower.

(4) A high-temperature resistant stainless steel comb plate is mounted at the U-shaped bent tube section adjacent to the bottom of the tube screen, the interval between adjacent tube screens is uniform and effectively fixed, thereby preventing increased abrasion of the tube screen with a small interval caused by too high flow of partial flue gas when the interval between some of the tube screens is not uniform.

The present invention relates to a high-temperature reheater anti-friction device for anti-friction of metal tubes on a heated surface of a high-temperature reheater adjacent to a soot blower, comprising a hole-type tube clamp arranged on a metal tube of a heated surface of a high-temperature reheater, an anti-friction box and an anti-friction cover, wherein the metal tube comprises a plurality of furnace tubes arranged in parallel at equal intervals, each furnace tube comprises a U-shaped bent tube section and a vertical tube section arranged above the U-shaped bent tube section, the anti-friction box is covered on the vertical tube section adjacent to the side of the soot blower, the anti-friction cover comprises a straight anti-friction cover and a 90° anti-friction cover, the straight anti-friction cover covers the innermost furnace tube on the side, adjacent to the soot blower, of the vertical tube section, the top of the straight anti-friction cover is welded to the bottom of the hole-type tube clamp, the 90° anti-friction cover covers the outermost furnace tube on the side, adjacent to the soot blower, of the U-shaped bent tube section, and the top of the 90° anti-friction cover is welded to the bottom of the anti-friction box, and the anti-friction cover is fixed with the furnace tube through an anti-friction cover access board. Compared with the prior art, the present invention has the advantages of reduced maintenance workload of the unit and prolonged service life of the metal tube.

REFERENCE NUMERALS IN THE FIGURES

1, hole-type tube clamp, 11, semi-circular docking unit, 12, circular mounting hole, 13, mounting bolt, 2, anti-friction box, 31, straight anti-friction cove, 32, 90° anti-friction cover, 33, anti-friction cover access board, 4, comb plate, 41, plate body, 42, strip-shaped hole, 5, soot blower, 6, metal tube, 61, vertical tube section, 62, U-shaped bent tube section, 7, horizontal flue.

DETAILED DESCRIPTION OF THE EMBODIMENTS

The present invention is described in detail below in combination with the accompanying drawings and a specific embodiment. Obviously, the described embodiment is a part but not all of the embodiments of the present invention. Based on the embodiment in the present invention, all the other embodiments obtained by those skilled in the art without any creative effort shall all fall within the protection scope of the present invention.

Embodiment

The present invention relates to a high-temperature reheater anti-friction device mounted on a metal tube 6 of a heated surface of a high-temperature reheater, and a soot blower 5 is arranged adjacent to the high-temperature reheater. The metal tube 6 includes a plurality of furnace tubes arranged in parallel at equal intervals. The metal tube 6 is arranged above the horizontal flue 7. As shown in FIG.

Figure 1:
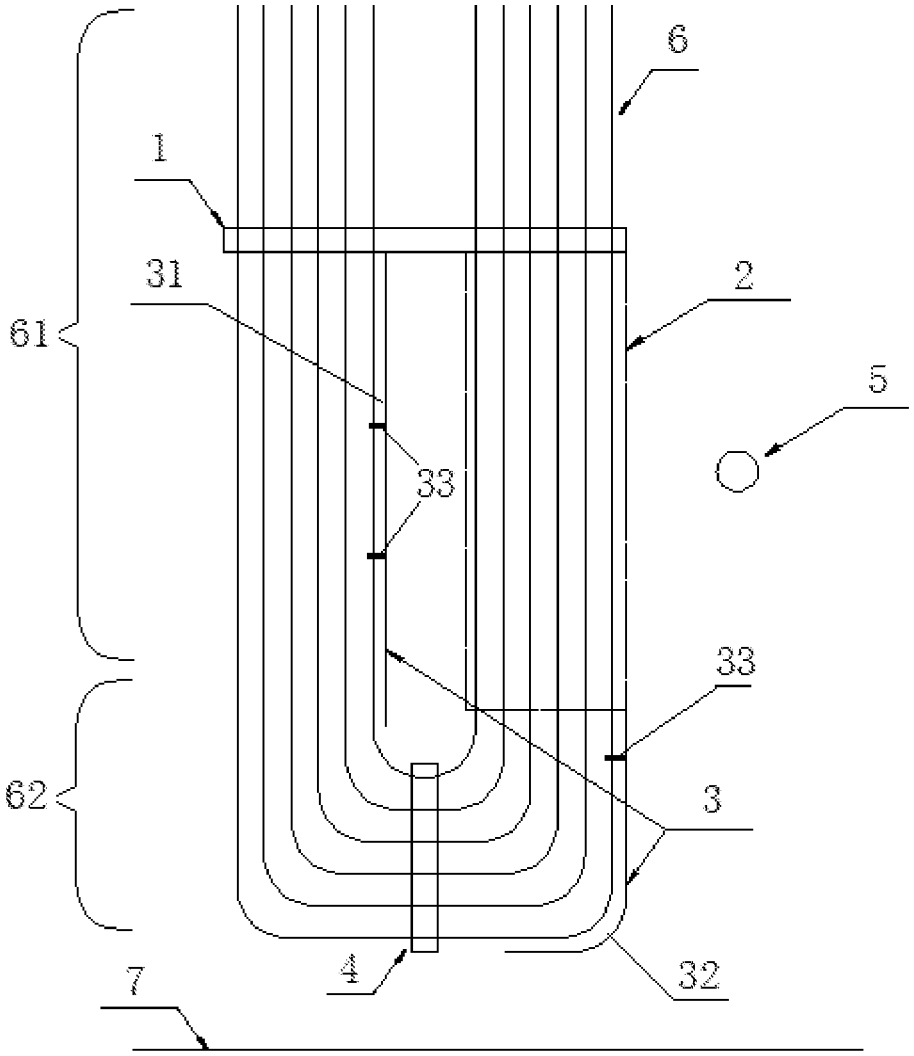
FIG. 1 is a structural schematic diagram of a main view of a high-temperature reheater anti-friction device in the present embodiment.
Figure 2:
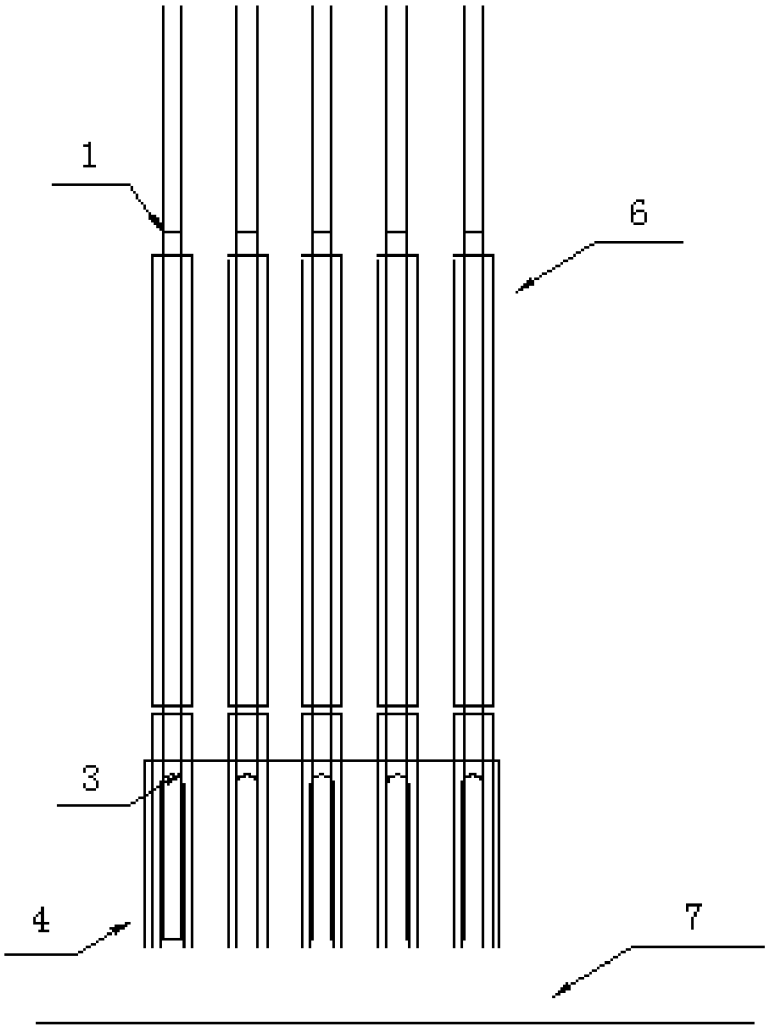
FIG. 2 is a structural schematic diagram of a side view of a high-temperature reheater anti-friction device in the present embodiment.

1 to FIG. 2, the device includes a hole-type tube clamp 1, an anti-friction box 2, an anti-friction cover 3 and a comb plate 4. Each single furnace tube of the metal tube 6 of the heated surface of the high-temperature reheater respectively includes a U-shaped bent tube section 62 and a vertical tube section 61 above the U-shaped bent tube section 62. A soot blower 5 is arranged adjacent to the vertical tube section 61 at a side above the U-shaped bent tube section 62. The hole-type tube clamp 1 is sleeved and clamped on the vertical tube section 61 of the metal tube 6.

Figure 9:
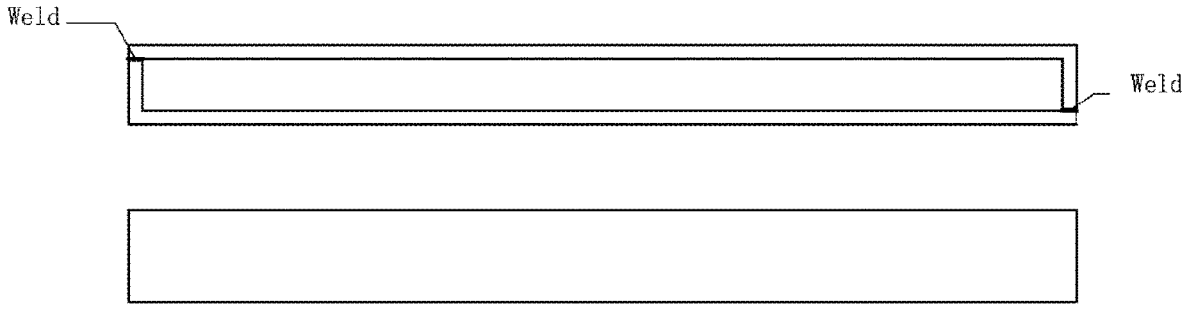
FIG. 9 is a structural schematic diagram of an anti-friction box of a high-temperature reheater anti-friction device in the present embodiment.

The anti-friction box 2 is a rectangular box with a hollow structure, as shown in FIG. 9. The anti-friction box 2 is covered on the vertical tube section 61 adjacent to the side of the soot blower 5, and the top of the anti-friction box 2 is welded to the bottom of the hole-type tube clamp 1. Further, the height of the anti-friction box 2: the upper part of the anti-friction box 2 starts from the hole-type tube clamp 1, and the lower part reaches the bending point of the furnace tube on the inner side of the U-shaped bent tube section 62; and the width of the anti-friction box 2: the anti-friction box 2 wraps all the vertical tube section 61 adjacent to the side of the soot blower 5.

The anti-friction cover 3 includes a straight anti-friction cover 31, a 90° anti-friction cover 32 and an anti-friction cover access board 33. The straight anti-friction cover 31 is a semi-circular vertical tubular structure with an open mouth, and is covered on the innermost furnace tube on the side, adjacent to the soot blower 5, of the vertical tube section 61, and after the straight anti-friction cover 31 is covered on the furnace tube, the inner side of the open end is welded to the two ends of the anti-friction cover access board 33, such that the straight anti-friction cover 31 clings to the furnace tube. The top of the straight anti-friction cover 31 is welded to the bottom of the hole-type tube clamp 1 to prevent from falling off.

Figure 7:
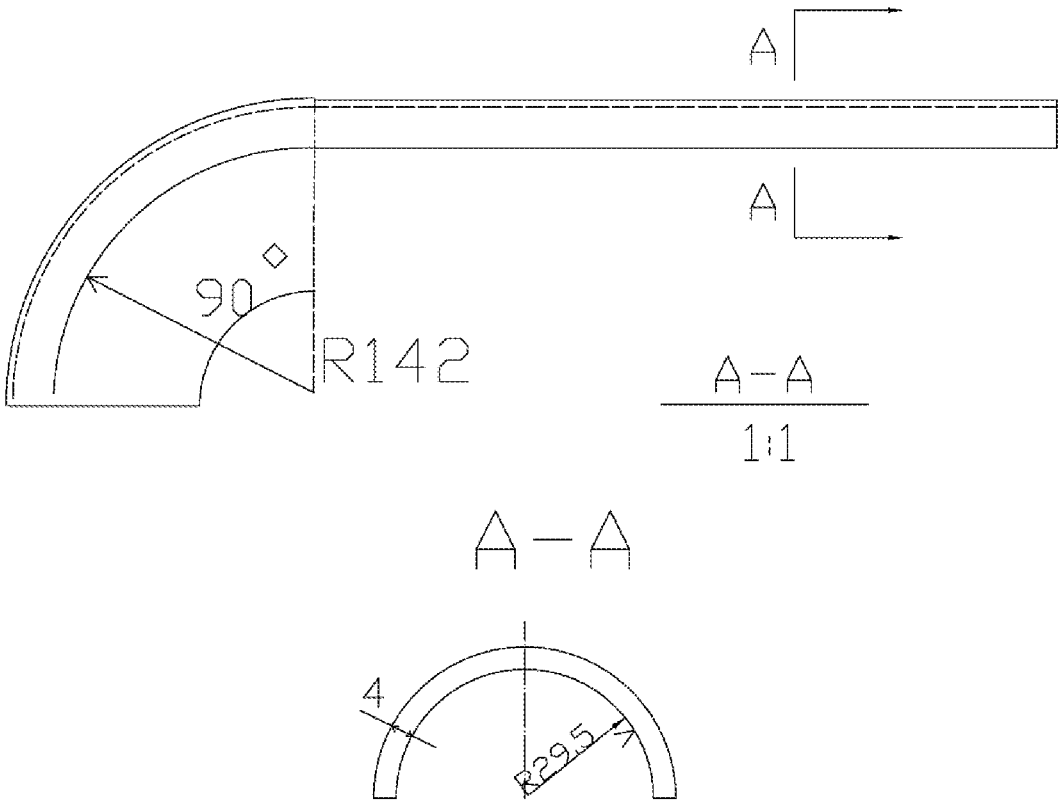
FIG. 7 is a structural schematic diagram of a 90° anti-friction cover of a high-temperature reheater anti-friction device in the present embodiment.

The 90° anti-friction cover 32 is a semi-closed tubular structure with bent corners, as shown in FIG. 7, and includes a straight section and a bent section, and the radian of the bent section is 90 degrees. The 90° anti-friction cover 32 is covered on the outermost furnace tube on the side, adjacent to the soot blower 5, of the U-shaped bent tube section 62 side through an open end, and after the 90° anti-friction cover is covered on the furnace tube, the inner side of the open end is welded with the two ends of the anti-friction cover access board 33, which in turn makes it fit tightly with the furnace tube. The top of the 90° anti-friction cover 32 is welded to the bottom of the anti-friction box 2, to prevent from falling off.

Figure 8:
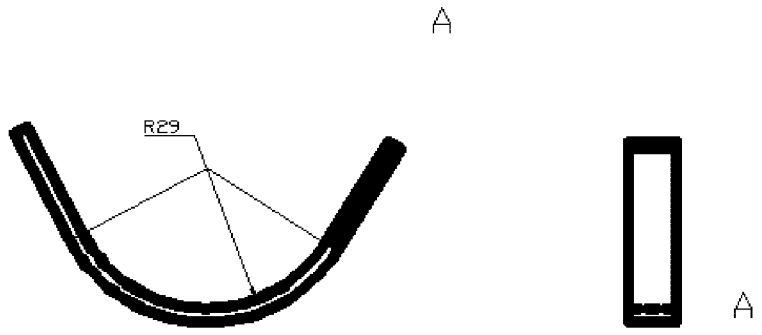
FIG. 8 is a structural schematic diagram of an anti-friction cover access board of a high-temperature reheater anti-friction device in the present embodiment.

As shown in FIG. 8, the anti-friction cover access board 33 is an arc-shaped plate structure, and the inner diameter corresponding to the radian of the anti-friction cover access board is the same as the outer diameter of the furnace tube, such that the straight anti-friction cover 31, the inner side of the open end of the 90° anti-friction cover 32 and the anti-friction cover access board 33 are stably welded, to completely cling to the furnace tube. Further, the height of the straight anti-friction cover 31: the upper part of the straight anti-friction cover 31 starts from the hole-type tube clamp 1, and the lower part reaches the bending point of the furnace tube on the inner side of the U-shaped bent tube section 62; and the height of the 90° anti-friction cover 32: the upper part of the 90° anti-friction cover 32 starts from the anti-friction box 2, and the lower part reaches the horizontal section of the furnace tube at the outer side of the U-shaped bent tube section 62, exceeding the bending point by 200 mm.

Figure 3:
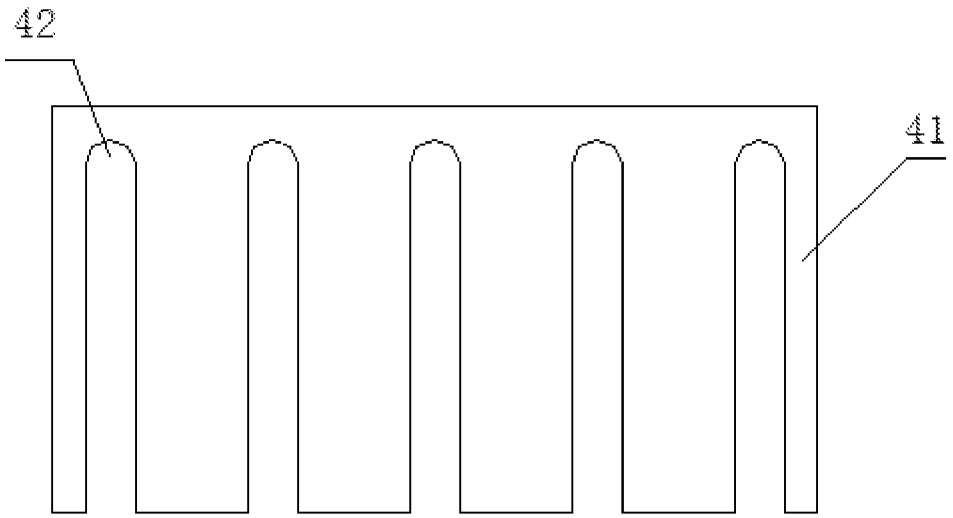
FIG. 3 is a structural schematic diagram of a comb plate of a high-temperature reheater anti-friction device in the present embodiment.

The central position of the U-shaped bent tube section 62 is mounted with a comb plate 4. As shown in FIG. 3, the comb plate 4 includes a plate body 41 and strip-shaped holes 42 arranged in parallel at equal intervals, and each strip-shaped hole 42 is arranged at one end of the plate body 41. The number of the strip-shaped hole 42 is the same as the number of the tube body of the metal tube 6, the interval of the strip-shaped holes 42 is the same as the interval of a plurality of furnace tubes arranged in parallel at equal intervals of the metal tube 6, and the width of each strip-shaped hole 42 is matched with the outer diameter dimension of a plurality of furnace tubes arranged in parallel at equal intervals of the metal tube 6.

Figure 4:
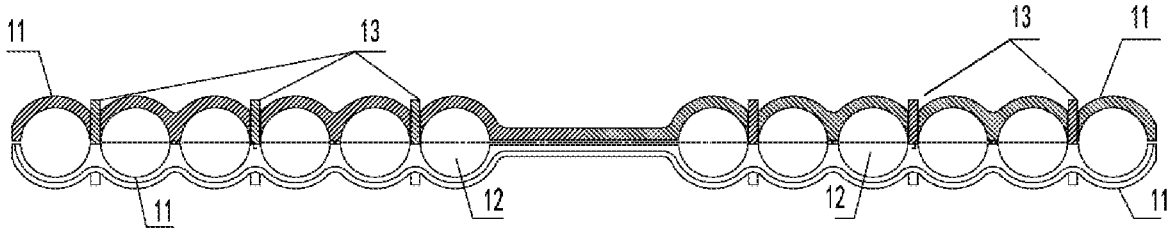
FIG. 4 is a structural schematic diagram of a main view of a hole-type tube clamp of a high-temperature reheater anti-friction device in the present embodiment.
Figure 5:
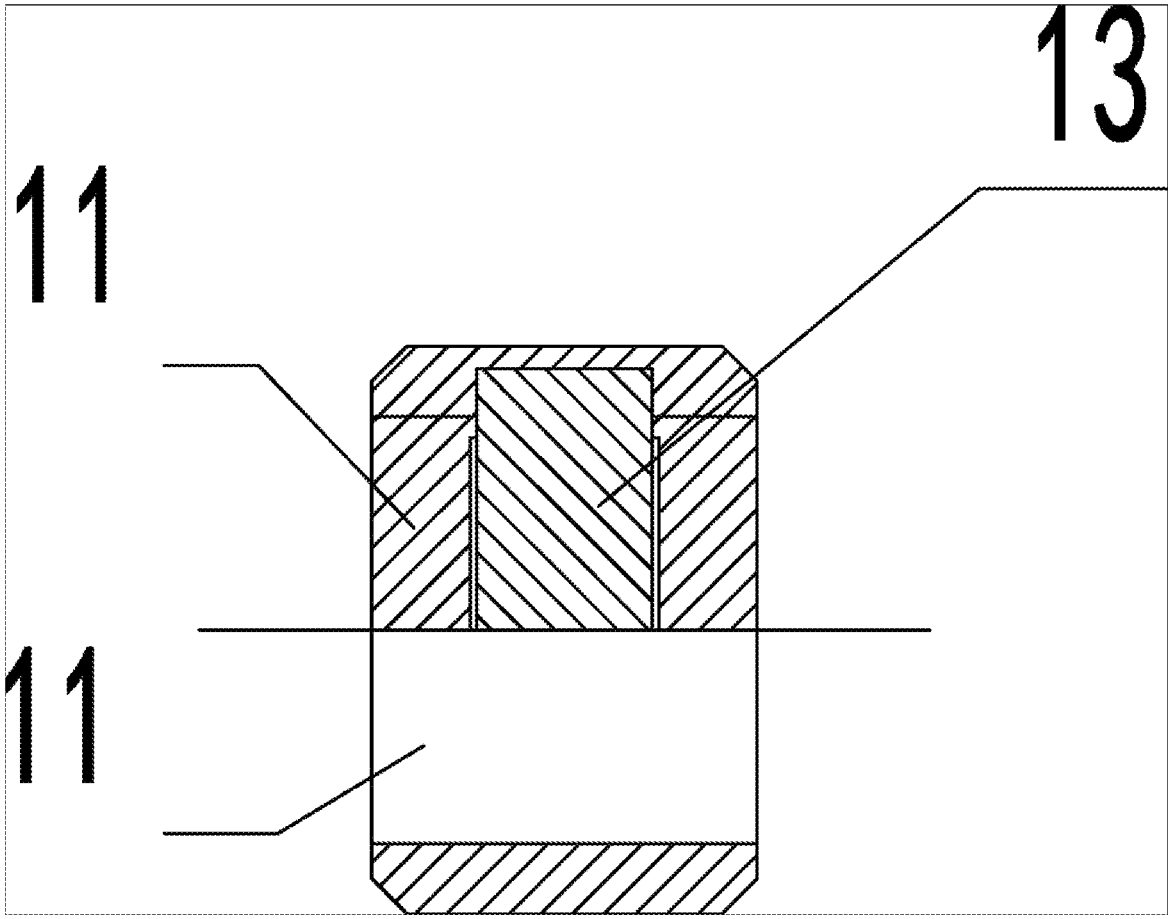
FIG. 5 is a structural schematic diagram of a side view of a hole-type tube clamp of a high-temperature reheater anti-friction device in the present embodiment.
Figure 6:
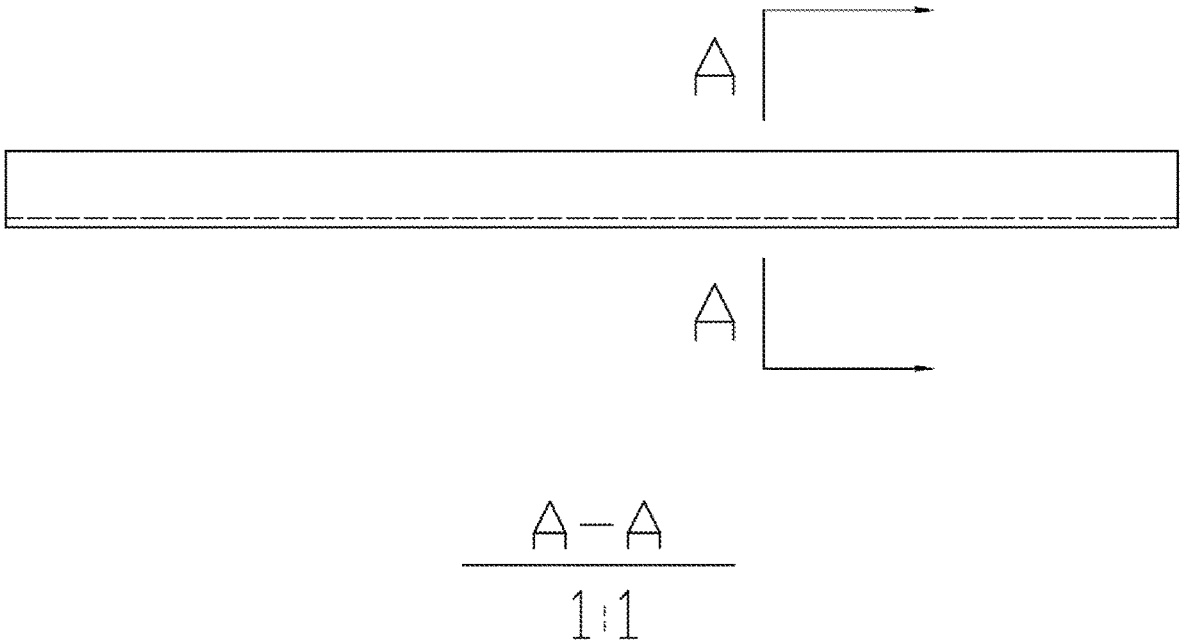
FIG. 6 is a structural schematic diagram of a straight anti-friction cover of a high-temperature reheater anti-friction device in the present embodiment.
Figure 6:
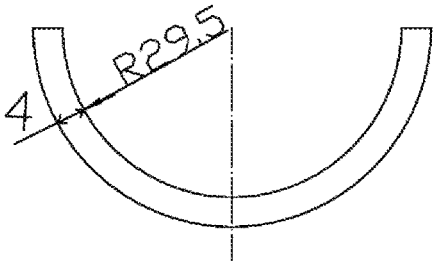

The hole-type tube clamp 1 is of a symmetrical structure and is cast in a symmetrical shape during manufacturing, as shown in FIGS. 4 and 5, specifically including two clamping parts arranged symmetrically, the two clamping parts are respectively provided with a central connecting plate and a plurality of parallel semi-circular docking units 11 which are arranged symmetrically on both sides of the central connecting plate, and the number of semi-circular docking units 11 of each clamping part is the same as the number of furnace tube bodies of the metal tube 6; the central position of each semi-circular docking unit 11 is provided with semi-circular holes of the same size and shape respectively, and the size and shape of each semi-circular hole is the same as the outer diameter dimension and cross-sectional shape of the furnace tube body of the metal tube 6; and two clamping parts are docked to form a tube clamp with a plurality of circular mounting holes 12. A mounting bolt 13 is respectively arranged between each semi-circular docking unit 11 of a clamping part, and the other clamping part is provided with a mounting hole for fitting with the mounting bolt, and after the two clamping parts are docked, fixed connection is achieved through the mounting bolt 13 and the mounting holes. The inner diameter dimension of the semi-circular docking unit 11 is the same as the outer diameter dimension of each single furnace tube of the vertical tube section 61 to be clamped.

In the present embodiment, as a preferred solution, the hole-type tube clamp 1, the anti-friction box 2, the anti-friction cover 3 and the comb plate are all made of stainless steel.

As to the high-temperature reheater anti-friction device of the present invention, through adding an anti-friction box and an anti-friction cover, the furnace tube within the effective blowing radius of the soot blower can be closed, and an anti-friction cover is added synchronously at the outermost furnace tube of the metal tube, thereby effectively avoiding damage to the furnace tube caused by blowing of a soot blower; at the same time, when an improved hole-type tube clamp is adopted and a comb plate is added, the tubes can be prevented from being out of rank and uneven interval of adjacent tube screens can be prevented. The systematic high-temperature reheater anti-friction device can effectively reduce scouring and abrasion of the flue gas and the soot blower on the furnace tube, and extend the operating life of the high-temperature reheater tube.

The above is merely a specific implementation of the present invention, but the protection scope of the present invention is not limited hereto, and those skilled in the art can easily conceive of various equivalent modifications or substitutions within the technical scope disclosed by the present invention, and these modifications or substitutions shall all fall within the protection scope of the present invention. Therefore, the protection scope of the present invention shall all fall within the protection scope of the claims.

We claim:

1. A high-temperature reheater anti-friction device for anti-friction of metal tubes (6) on a heated surface of a high-temperature reheater adjacent to a soot blower (5);

wherein the high-temperature reheater anti-friction device comprises a hole-type tube clamp (1), an anti-friction box (2) and an anti-friction cover (3) arranged on the metal tubes (6) on the heated surface of the high-temperature reheater, the metal tube (6) comprises a plurality of furnace tubes arranged in parallel at equal intervals, each furnace tube comprises a U-shaped bent tube section (62) and a vertical tube section (61) arranged above the U-shaped bent tube section, the hole-type tube clamp (1) is sleeved and clamped on the vertical tube section (61) of the metal tube (6), the anti-friction box (2) is covered on the vertical tube section (61) adjacent to the side of the soot blower (5), the anti-friction cover (3) comprises a 90° anti-friction cover (32) covering the outermost furnace tube on the side, adjacent to the soot blower (5), of the U-shaped bent tube section (62), and a straight anti-friction cover (31) covering the innermost furnace tube on the side, adjacent to the soot blower (5), of the vertical tube section (61), the top of the 90° anti-friction cover (32) is welded to the bottom of the anti-friction box (2), and the top of the straight anti-friction cover (31) is welded to the bottom of the hole-type tube clamp (1).

2. The high-temperature reheater anti-friction device of claim 1, further comprising a comb plate (4), wherein the comb plate (4) is mounted in the central position of the U-shaped bent tube section (62).

3. The high-temperature reheater anti-friction device of claim 2, wherein the top of the anti-friction box (2) is welded to the hole-type tube clamp (1).

4. The high-temperature reheater anti-friction device of claim 2, wherein the 90° anti-friction cover (32) and the straight anti-friction cover (31) are respectively fixed to the corresponding furnace tube by means of an anti-friction cover access board (33).

5. The high-temperature reheater anti-friction device of claim 2, wherein the comb plate (4) comprises a plate body (41) and a number of strip-shaped holes (42) arranged in parallel at equal intervals at one end of the plate body (41), the number of the strip-shaped holes (42) is the same as the number of furnace tubes of the metal tube (6), the interval of each strip-shaped hole (42) is the same as the interval of each furnace tube of the metal tube (6), and the width of each strip-shaped hole (42) matches the outer diameter dimension of each furnace tube of the metal tube (6).

6. The high-temperature reheater anti-friction device of claim 1, wherein the hole-type tube clamp (1) comprises two clamping parts arranged symmetrically, the two clamping parts are respectively provided with a central connecting plate and a plurality of parallel semi-circular docking units (11) which are arranged symmetrically on both sides of the central connecting plate, and the central position of each semi-circular docking unit (11) is provided with a semi-circular hole for inserting each single furnace tube of the vertical tube section (61), and the two clamping parts are provided with fitting pieces to form a tube clamp with a plurality of circular mounting holes (12) after fitting.

7. The high-temperature reheater anti-friction device of claim 6, wherein the number of the semi-circular docking units (11) in each clamping part is the same as the number of furnace tube bodies of the metal tube (6), and the dimension and shape of each semi-circular hole are the same as the outer diameter dimension and cross-sectional shape of the furnace tube body of the metal tube (6).

8. The high-temperature reheater anti-friction device of claim 6, wherein the fitting piece comprises a mounting bolt (13) arranged between each semi-circular docking unit (11) of one clamping part and a mounting hole arranged on the other clamping part for fitting with the mounting bolt (13).

9. The high-temperature reheater anti-friction device of claim 6, wherein the inner diameter dimension of the semi-circular docking unit (11) is the same as the outer diameter dimension of each single furnace tube of the vertical tube section (61) to be clamped.

10. The high-temperature reheater anti-friction device of claim 4, wherein the anti-friction cover access board (33) is an arc-shaped plate structure, and the inner diameter corresponding to the radian of the anti-friction cover access board (33) is the same as the outer diameter of the furnace tube.

* * * * *